US005439344A

United States Patent [19]

Yoshizuka et al.

[11] Patent Number: 5,439,344

[45] Date of Patent: Aug. 8, 1995

[54] CORRUGATED CARDBOARD BOX COUNTING AND DISCHARGING DEVICE

[75] Inventors: Haruo Yoshizuka, Kanazawa; Junichi Takeda, Hakui, both of Japan

[73] Assignee: Kabushiki Kaisha Ishikawa Seisakusho, Ltd., Kanazawa, Japan

[21] Appl. No.: 334,076

[22] Filed: Nov. 4, 1994

[51] Int. Cl.[6] ..... B65G 60/00

[52] U.S. Cl. ..... 414/789.1; 414/790.3; 414/795.1; 414/796

[58] Field of Search ..... 414/788.4, 788.9, 789.1, 414/790.3, 795, 795.1, 796

[56] References Cited

U.S. PATENT DOCUMENTS

| | | | |
|---|---|---|---|
| 2,963,177 | 12/1960 | Shields . | |
| 3,063,577 | 11/1962 | Shields . | |
| 3,203,561 | 8/1965 | Shields . | |
| 3,409,148 | 11/1968 | Shields . | |
| 4,522,617 | 6/1985 | Mowry | 414/790.3 X |
| 4,957,409 | 9/1990 | Fukao et al. | 414/788.4 |

FOREIGN PATENT DOCUMENTS 1121917 1/1962 Germany .

*Primary Examiner*—Michael S. Huppert
*Assistant Examiner*—Janice L. Krizek
*Attorney, Agent, or Firm*—Burns, Doane, Swecker & Mathis

[57] ABSTRACT

A device for counting and discharging corrugated cardboard boxes which is provided in a corrugated cardboard box making machine wherein a rotary screw is arranged for receiving corrugated cardboard boxes one by one forwarded thereto and successively stacking and storing said boxes vertically upward from the bottom, and when the number of the boxes have reached a predetermined number, a group of said boxes are sorted and discharged in a horizontal direction by a first and second pusher bars for a next manufacturing process wherein each of the pusher bars is provided with a dividing member for sorting the boxes.

3 Claims, 6 Drawing Sheets

CORRUGATED CARDBOARD BOX COUNTING AND DISCHARGING DEVICE

BACKGROUND OF THE INVENTION

1. Technical Field of the Invention

The present invention relates to a corrugated cardboard box counting and discharging device which is provided in a corrugated cardboard box making machine wherein manufactured and folded corrugated cardboard boxes successively forwarded are temporarily stored until the number of the corrugated cardboard boxes reach a predetermined number, and then a group of the stored corrugated cardboard boxes are counted and discharged for a next manufacturing process.

2. Description of Related Art

In a conventional device, it has been arranged to discharge a group of folded corrugated cardboard boxes for a next manufacturing process when the number of the boxes have reached a predetermined number since it was considered preferable to bundle a predetermined number of folded corrugated cardboard boxes for facilitating the handling of said boxes wherein the folded corrugated cardboard boxes successively transported one by one in a horizontal direction from a delivery section in a corrugated cardboard box making machine are vertically stacked upward from the bottom and stored temporarily until the number of the corrugated cardboard boxes reach a predetermined number.

However, when the corrugated cardboard boxes divided into a group of a predetermined number is transported for a next manufacturing process, a corrugated cardboard box which is positioned uppermost of a next group tends to come in close contact with the bottom of a corrugated cardboard box positioned lowermost of the preceding group due to extremely short time interval between the time when a first box of the next group is forwarded and the time when a group of the stored boxes are sent out. The self-weight possessed by the stacked boxes also causes such an inconvenience whereby more than a predetermined number of corrugated cardboard boxes are transported with the preceding group, and corrugated cardboard boxes of each group are not discharged accurately in number.

With a view to solve the problem described above, the applicant of the present invention has proposed a device in U.S. Pat. No. 4,957,409 issued on Sep. 18, 1990 wherein folded corrugated cardboard boxes which have been forwarded are vertically stacked upward from the bottom keeping a very small gap between each one of the lower and upper boxes, and then a corrugated cardboard box positioned uppermost among the stacked boxes is moved in a horizontal direction one by one, and the number of the moved boxes are counted by a sensor. Thereafter, when the number of the boxes counted have reached a predetermined number, a bunch of the stacked corrugated cardboard boxes divided into a group of a predetermined number is moved in a horizontal direction all together.

However, there still remains a problem that each group of the corrugated cardboard boxes can not be discharged accurately in a predetermined number due to various manufacturing conditions such as a kind of sheet of a corrugated cardboard box and manufacturing speed.

SUMMARY OF THE INVENTION

An object of the present invention is to provide a device which is capable of accurately counting the number of corrugated cardboard boxes, and efficiently discharging the boxes for a next process.

Other objects and features of the present invention will become more apparent from the following description taken in conjunction with the accompanying drawings which illustrate specific embodiments of the invention.

DESCRIPTION OF THE PREFERRED EMBODIMENTS

Description will now be made hereinafter on an embodiment of a device which is applied to the present invention with reference to accompanying drawings.

Figure 1:
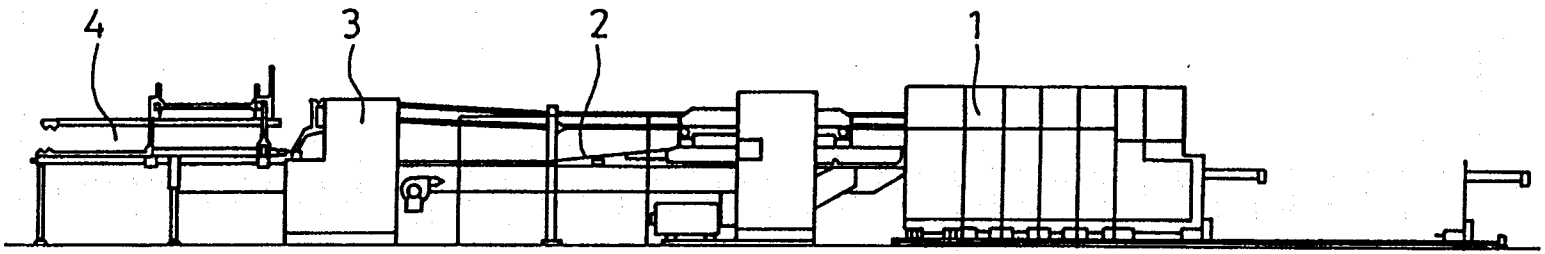
FIG. 1 is a front view showing an example of a corrugated cardboard box making machine to which the present invention is applied.

In FIG. 1, numeral 1 represents a unit comprising a printing section, creasing section, slotting section and sizing section, numeral 2 shows a folding unit for folding a corrugated cardboard box which has been processed in the unit 1, numeral 3 indicates a counting and discharging unit wherein manufactured and folded corrugated cardboard boxes are temporarily stored until the number of the folded boxes reach a predetermined number, and then, a group of the folded boxes are discharged for a next process, and numeral 4 represents a transport section from where the corrugated cardboard boxes are forwarded to a binding device (not illustrated) for a next process.

Figure 2:
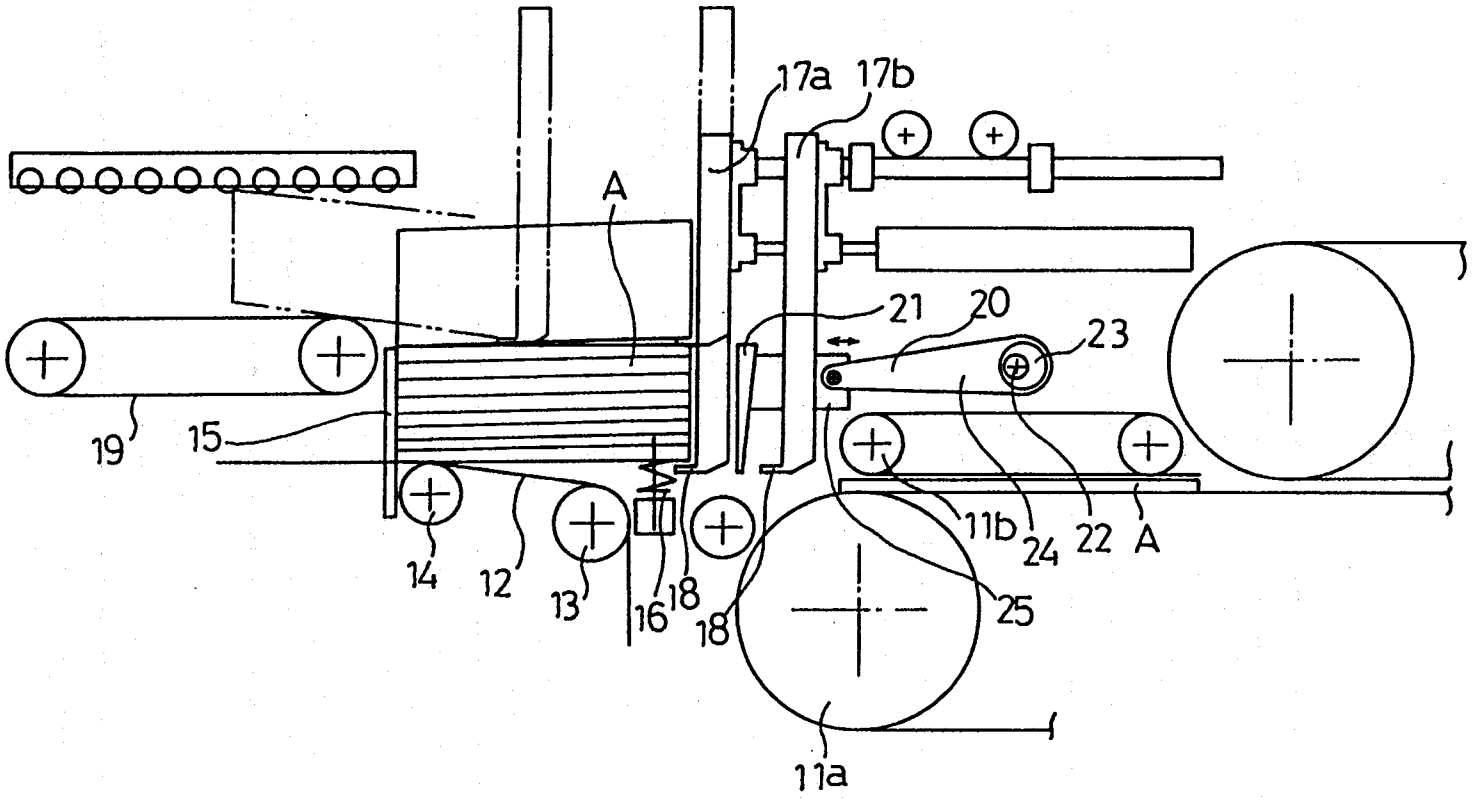
FIG. 2 is a front view showing an example of a device to which the present invention is applied.
Figure 3:
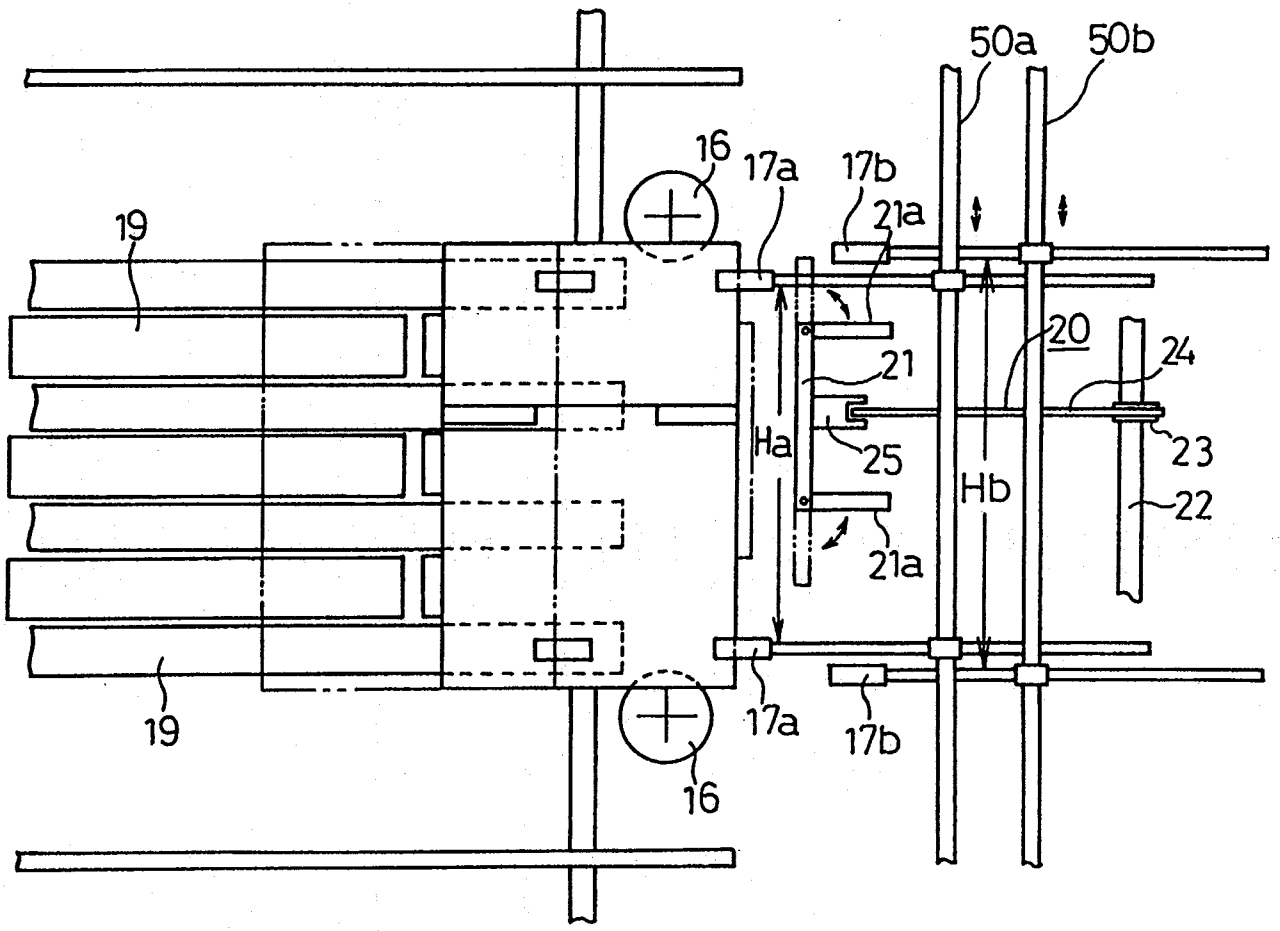
FIG. 3 is a plan view of the device illustrated in FIG. 2.

FIGS. 2 and 3 show the counting and discharging unit 3 in detail. In the figures, numerals 11*a*, 11*b* represent feed rollers provided for forwarding a folded corrugated cardboard box A to the counting and discharging unit 3 after the box A has been processed in the printing section, creasing section, slotting section and sizing section, numeral 12 shows a feed belt for placing a folded corrugated cardboard box A successively forwarded thereto. The feed belt 12 is stretched between rollers 13 and 14.

Numeral 15 indicates a front stopper which is provided for stopping a corrugated cardboard box transported through the feed belt 12. The front stopper 15 is movably disposed in a vertical direction to coincide with a height which corresponds with a height of a predetermined number of corrugated cardboard boxes.

Numeral 16, 16 shows a rotary screw provided with a spiral vane which is wound spirally two-three turns, and is disposed between the feed rollers 11*a*,11*b* and feed belt 12. A corrugated cardboard box nipped between the spiral vane is gradually moved upward with a rotation of the rotary screw 16.

Numerals 17*a*,17*b* represent a first and second pusher bars which are provided for moving a group of corrugated cardboard boxes stacked and stored above the rotary screw 16,16. When the number of the stacked and stored corrugated cardboard boxes A have reached a predetermined number, the boxes are moved forward from the right to the left direction in the FIG. 2 to be transported by the first and second pusher bars 17*a*,17*b* to a conveyer 19 for a next process.

As illustrated in FIG. 3, the first pusher bar 17*a* and the second pusher bar 17*b* comprises a pair of bars respectively and provided on the left and right sides, and are movably attached to guide shafts 50*a*,50*b* whereby a space Ha between the bars 17*a* on the left side and right side, and a space Hb between the bars 17*b* on the left side and right side can be adjusted.

Numeral 18 indicates a dividing member which is provided for dividing a group of a predetermined number of corrugated cardboard boxes vertically stacked upward from the bottom by the rotary screw 16 from a group of corrugated cardboard boxes being successively forwarded. The dividing member 18 is integrally attached to the lower end portion of the first and second pusher bars 17*a*,17*b* like a claw.

Numeral 20 represents a truing device which is provided for regulating irregularities at the sizing portion of folded corrugated cardboard boxes. The truing device 20 comprises a driving source and a truing plate 21 which comes in contact with the irregular rear end of a corrugated cardboard box A. More particularly, a cam 23 is attached eccentrically relative to a driving shaft 22, and the cam 23 is loosely fitted in a hole of an arm 24. With a rotation of the driving shaft 22, the arm 24 is laterally moved by the eccentric cam 23, and the truing plate 21 is laterally moved through a bracket 25.

As shown by solid and phantom lines in FIG. 3, both end portions 21*a*,21*a* of the truing plate 21 are foldably formed. When it is desired to set a space Ha between the first pusher bars 17*a*,17*a* smaller, for instance, said both end portions 21*a*,21*a* of the truing plate 21 may be folded as shown by solid line in FIG. 3.

Description will now be made on how the apparatus of the present invention operates.

Figure 4:
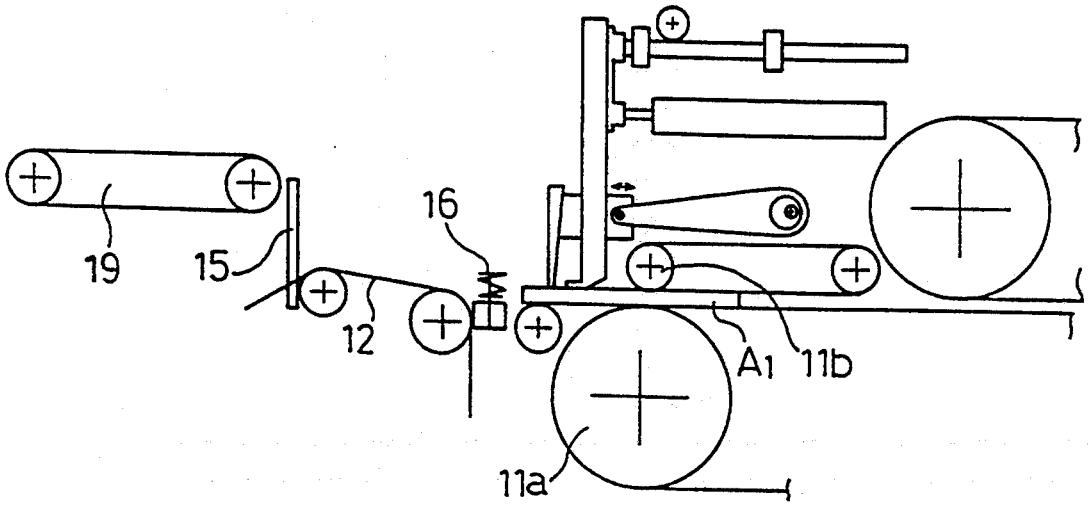
FIG. 4 is an explanatory view showing how a device of the present invention works.
Figure 5:
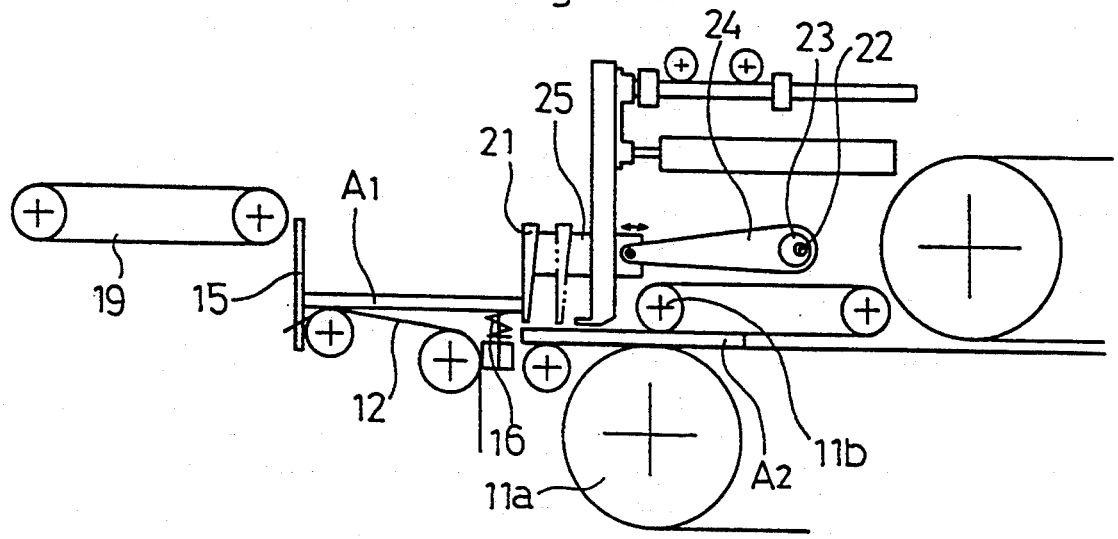
FIG. 5 is an explanatory view showing how a device of the present invention works.

As illustrated in FIG. 4, a folded corrugated cardboard box A1 which has completed a preliminary process such as printing, creasing, slotting and sizing is forwarded by the feed rollers 11*a*, 11*b*, to be placed on the feed belt 12 passing through the spiral vane of the rotary screw 16. Then, the leading end of the corrugated cardboard box A1 placed on the feed belt 12 is stopped by the front stopper 15. On the other hand, the rear end of the box A is gradually moved upward by riding on the rotary screw 16 as illustrated in FIG. 5. When the driving shaft 22 is driven as described above, the truing plate 21 is moved forward from the right to the left direction in the figure through the eccentric cam 23, arm 24 and bracket 25 to contact the rear end of the Box A1 and an irregularity is regulated.

Figure 6:
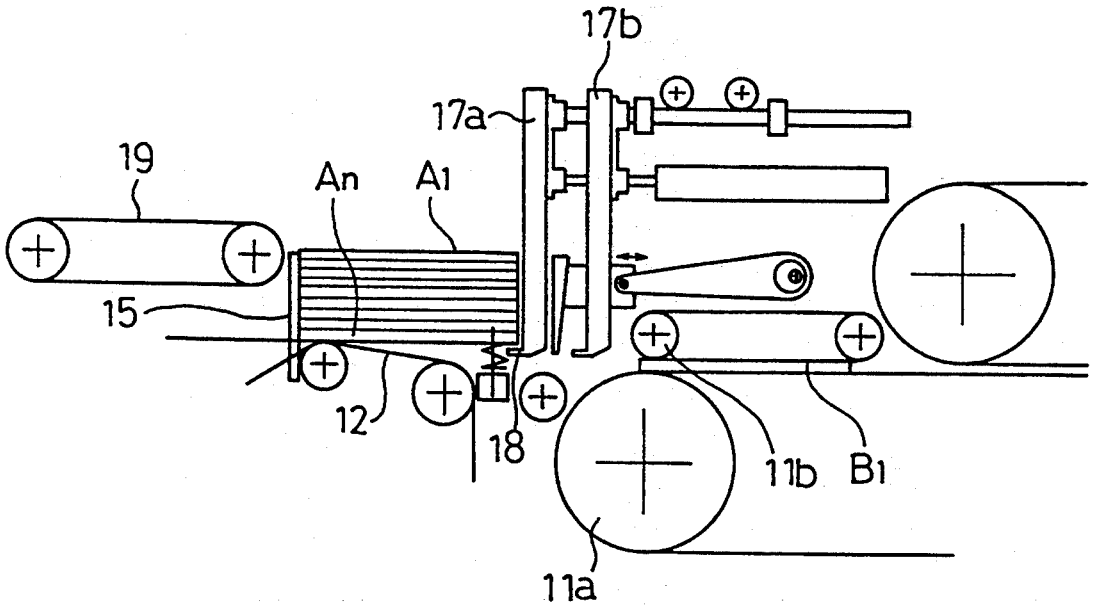
FIG. 6 is an explanatory view showing how a device of the present invention works.

Then, a next corrugated cardboard box A2 is forwarded by the feed rollers 11*a*, 11*b*, and succeeding boxes are vertically stacked upward from the bottom and stored in a space between the rotary screw 16 and the front stopper 15 in the same manner as the corrugated cardboard box A1 as described above. When the number of the stacked corrugated cardboard boxes have reached a predetermined number n, the first pusher bar 17*a* is moved forward from the right to the left direction as shown in FIG. 6, and the dividing member 18 integrally attached to the lower end portion of the pusher bar 17*a* is inserted into the bottom of a corrugated cardboard box An positioned lowermost.

Figure 7:
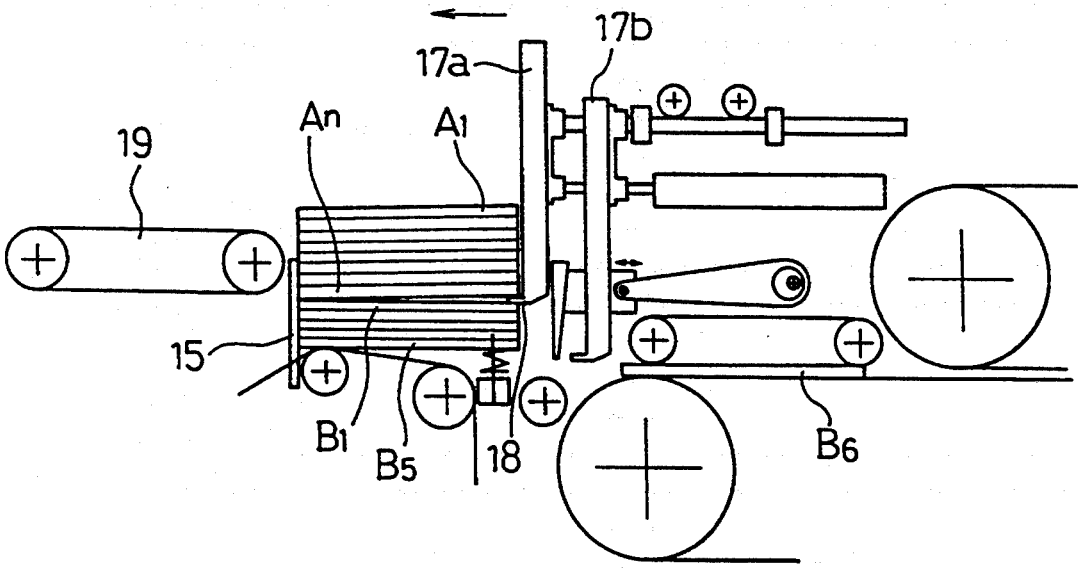
FIG. 7 is an explanatory view showing how a device of the present invention works.

A first corrugated cardboard box B1 of a next group is then forwarded by the feed rollers 11*a*, 11*b*, and each of succeeding corrugated cardboard boxes B2, B3, . . . is successively fed to underneath the dividing member 18 attached to the pusher bar 17*a* as illustrated in FIG. 7 whereby the upper group of corrugated cardboard boxes (A1-An) and the lower group of corrugated cardboard boxes (B1, B2 . . .) are divided distinctly by the dividing member 18. At this stage, the first pusher bar 17*a* is moved upward as the number of boxes increase.

Figure 8:
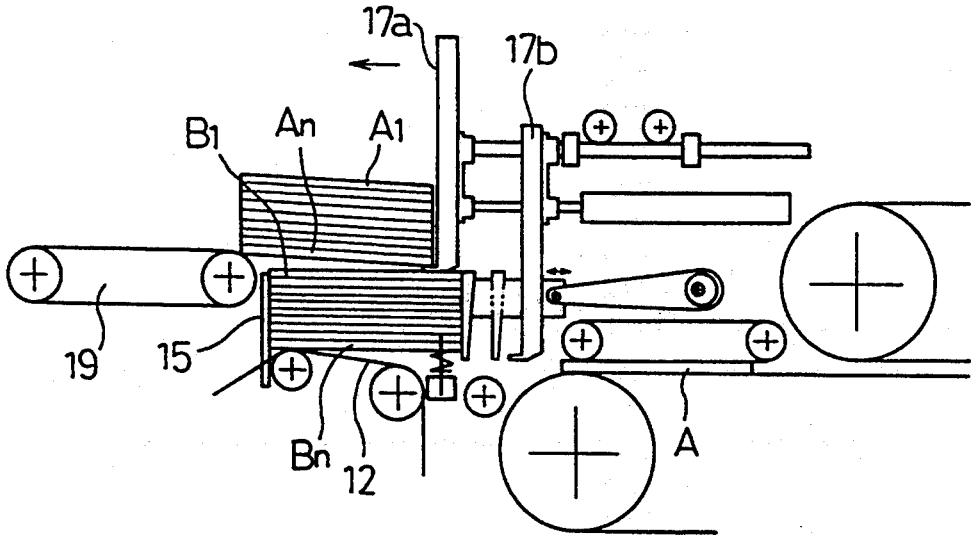
FIG. 8 is an explanatory view showing how a device of the present invention works.
Figure 9:
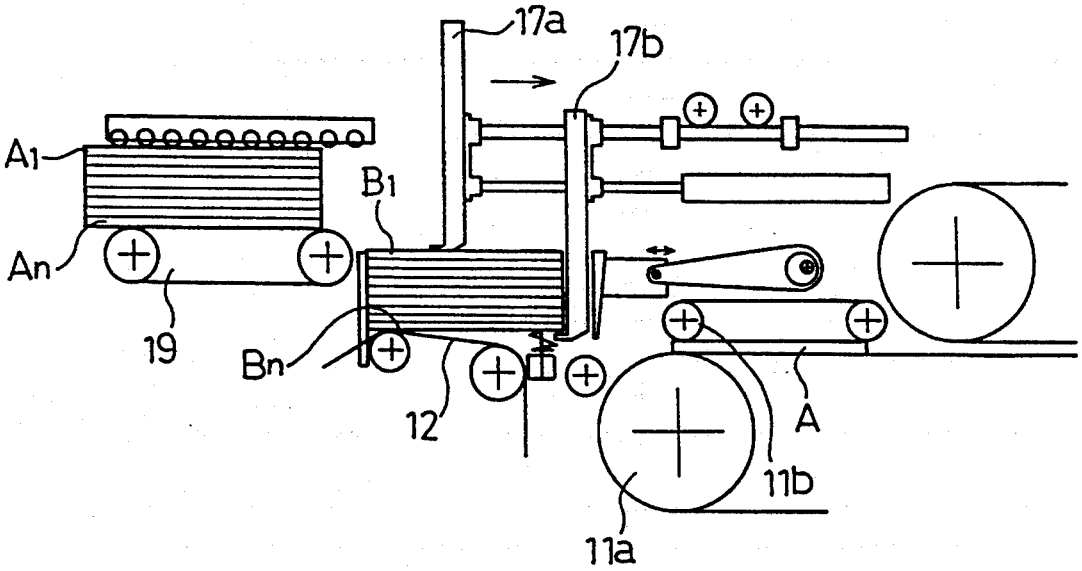
FIG. 9 is an explanatory view showing how a device of the present invention works.

When the bottom of a corrugated cardboard box An positioned lowermost of the upper group (A1-An) is lifted up to the same level as a height of the front stopper 15, the first pusher bar 17*a* is further moved forward from the right to the left direction in the figure as shown by arrow in FIG. 8, and a predetermined number of corrugated cardboard boxes (A1-An) are placed all together on a transport conveyer 19 as illustrated in FIG. 9.

Thereafter, the first pusher bar 17*a* is moved backward from the left to the right direction as shown by arrow in FIG. 9 to return to the original waiting position above the feed rollers 11*a*, 11*b*. On the other hand, the second pusher bar 17*b* is moved forward from the right to the left direction in the figure when the number of a next group of corrugated cardboard boxes have reached a predetermined number as illustrated in FIG. 9 in the same manner as the first pusher bar 17*a*. Then, the second pusher bar 17*b* takes the same action as the first pusher bar 17*a*.

With the reciprocal lateral moving action of the pusher bars 17*a* and 17*b* as described above, a predetermined number of corrugated cardboard boxes n are accurately counted and discharged for a next process.

When manufactured and folded corrugated cardboard boxes A are forwarded by the feed rollers 11*a*, 11*b* and moved in a horizontal direction until the boxes are stopped by the front stopper 15, each of the boxes A is held inbetween the spiral vane of the rotary screw 16 having a very small gap in a vertical direction so that contact friction between the boxes A is avoided. Moreover, two groups of the corrugated cardboard boxes (A1-An) and (B1-Bn) are divided distinctly since the dividing member 18 provided integrally with the first and second pusher bars 17*a*, 17*b* lies between the bottom surface of a lowermost corrugated cardboard box An of a preceding group and the upper surface of an uppermost corrugated cardboard box of a succeeding group.

Furthermore, since there are arranged two sets of pusher bars 17*a*, 17*b* integrally provided with the dividing member 18, even if one pusher bar 17*a* is in operation, another pusher 17*b* is readily available for a next operation to perform an operation efficiently.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A corrugated cardboard box counting and discharging device which is arranged to vertically stack and store folded corrugated cardboard boxes successively forwarded in a horizontal direction until the number of said boxes reach a predetermined number, and a group of the predetermined number of the boxes are moved all together in a horizontal direction again and discharged for a next process, comprising:

a rotary screw provided with a spiral vane which is spirally wound two or three turns for receiving corrugated cardboard boxes one by one forwarded thereto and successively stacking said boxes vertically upward from the bottom;

a first pusher bar and a second pusher bar each provided with a dividing member for sorting a group of corrugated cardboard boxes successively forwarded wherein when said stacked and stored corrugated cardboard boxes have reached a predetermined number, the dividing member is inserted into the bottom of a lowermost corrugated cardboard box for transporting the predetermined number of the boxes stacked on the dividing member in a horizontal direction for a next process; and a driving source for reciprocally operating the first pusher bar and second pusher bar.

2. A corrugated cardboard box counting and discharging device as claimed in claim 1, further comprising:

a front stopper for regulating the leading end of a group of stacked corrugated cardboard boxes; and a truing device for pushing the rear end of the group of corrugated cardboard boxes and truing the rear end of said group of boxes.

3. A corrugated cardboard box counting and discharging device as claimed in claim 2 wherein each of the first pusher bar and the second pusher bar comprising a pair of bars provided at right and left sides with adjustable space between the pair of bars, and both end portions of a truing plate of the truing device are arranged to be foldable.

* * * * *